US012214941B2

(12) United States Patent
Brundage

(10) Patent No.: US 12,214,941 B2
(45) Date of Patent: Feb. 4, 2025

(54) SELF-CENTERING FEATURES FOR STACKABLE CONTAINERS

(71) Applicant: WestRock Shared Services, LLC, Atlanta, GA (US)

(72) Inventor: David J. Brundage, Salinas, CA (US)

(73) Assignee: WestRock Shared Services, LLC, Atlanta, GA (US)

( * ) Notice: Subject to any disclaimer, the term of this patent is extended or adjusted under 35 U.S.C. 154(b) by 40 days.

(21) Appl. No.: 18/211,985

(22) Filed: Jun. 20, 2023

(65) Prior Publication Data

US 2023/0406563 A1 Dec. 21, 2023

Related U.S. Application Data

(60) Provisional application No. 63/353,782, filed on Jun. 20, 2022.

(51) Int. Cl.
*B65D 5/00* (2006.01)

(52) U.S. Cl.
CPC ..... *B65D 5/001* (2013.01)

(58) Field of Classification Search
CPC ..... B65D 5/001; B65D 5/5405
USPC ..... 206/503
See application file for complete search history.

(56) References Cited

U.S. PATENT DOCUMENTS 4,245,773 A * 1/1981 Stollberg ..... B65D 5/6644 206/815
4,349,147 A * 9/1982 Jensen ..... B65D 5/003 206/509
5,039,005 A * 8/1991 Flaming ..... B65D 5/001 229/162.1
5,535,941 A * 7/1996 Garza ..... B65D 5/002 229/918
5,839,650 A * 11/1998 Sheffer ..... B65D 5/001 229/117.16
6,092,716 A * 7/2000 Smith ..... B65D 5/16 229/164
6,131,805 A * 10/2000 Gasior ..... B65D 5/0025 229/174
6,354,487 B1 * 3/2002 Muise, Jr. ..... B65D 5/0015 206/508
6,641,032 B1 * 11/2003 Schilling ..... B65D 5/0025 206/509
7,635,080 B2 * 12/2009 Conway ..... B65D 5/0045 229/177

(Continued)

*Primary Examiner* — Don M Anderson
*Assistant Examiner* — Justin Caudill
(74) *Attorney, Agent, or Firm* — Neil G. Cohen; Rohini K. Garg

(57) ABSTRACT

A container includes a polygonal section comprising lateral walls surrounding an interior space. An upper wall forms a top bound on the interior space. A lower wall forms a bottom bound on the interior space. An alignment tab straddles a respective one of the upper fold lines. The alignment tab also has an intermediate fold line between the first and second ends of the alignment tab that is closer to the first end than to the second end, such that the alignment tab projects upward from the upper wall and separates two vertical, inward facing alignment edges at an upper end of the adjacent one of the lateral walls. A retention tab extends downward from the adjacent one of the lateral walls and is configured to engage two vertical, inward facing alignment edges of a similar container for alignment in a stack.

20 Claims, 8 Drawing Sheets

(56) References Cited

U.S. PATENT DOCUMENTS

| | | | | |
|---|---|---|---|---|
| 7,677,434 | B2 * | 3/2010 | Fry | B65D 5/0015 229/113 |
| 2014/0374303 | A1 * | 12/2014 | Martinez | B65D 5/003 206/508 |
| 2015/0115023 | A1 * | 4/2015 | Brundage | B65D 5/6632 229/185 |
| 2015/0251797 | A1 * | 9/2015 | Carman | B65D 5/4295 229/148 |
| 2016/0009439 | A1 * | 1/2016 | Armstrong | B65D 5/22 206/509 |
| 2016/0122073 | A1 * | 5/2016 | Aguirre | B65D 5/443 206/509 |

* cited by examiner

SELF-CENTERING FEATURES FOR STACKABLE CONTAINERS

CROSS REFERENCE TO RELATED APPLICATIONS

This Application claims the benefit of U.S. Provisional Patent Application No. 63/353,782, filed on Jun. 20, 2022. The entire contents of this application are incorporated herein by reference in their entirety.

BACKGROUND

1. Field

The present disclosure relates to containers for containing product for shipping, storage, and the like, and more particularly to stackable containers.

2. Description of Related Art

Containers such as corrugated paper shipping containers can be stacked onto pallets so that they can be moved and stored in palletized form. One challenge has been finding ways to facilitate proper alignment of the stacked containers during the stacking process, as well as keeping the stacking alignment stable after stacking. Various designs for alignment features have been proposed, such as locking tabs on one container that extend into a hole in the container above. Some of these designs involve extra machines and/or gluing beyond the normal box-erecting equipment. The holes in the bottom of the containers can be acceptable for some types of product, but not for others. Moreover, the designs are typically acceptable for stacking structures where one containers is stacked directly onto the same footprint as the containers below, but the tabs and holes may not accommodate other stacking structures such as pin-wheeled stacking or cross tied stacking.

The conventional techniques have been considered satisfactory for their intended purpose. However, there is an ever present need for improved systems and methods for self-centering features for stackable containers. This disclosure provides a solution for this need.

SUMMARY

A container includes a polygonal section comprising lateral walls surrounding an interior space. An upper wall forms a top bound on the interior space. The upper wall is connected to at least two of the lateral walls by upper fold lines. A lower wall forms a bottom bound on the interior space. The lower wall is connected to at least two of the lateral walls by lower fold lines. There can be eight total lateral walls. It is also contemplated that there can be four total lateral walls, or any other suitable number of walls.

An alignment tab straddles a respective one of the upper fold lines. A first end of the alignment tab is connected to the upper wall by a first join line and a second end of the alignment tab is connected to an adjacent one of the lateral walls by a second join line. The alignment tab has two opposed lateral sides crossing the respective one of the upper fold lines. The alignment tab also has an intermediate fold line between the first and second ends of the alignment tab that is closer to the first end than to the second end, such that the alignment tab projects upward from the upper wall and separates two vertical, inward facing alignment edges at an upper end of the adjacent one of the lateral walls.

A retention tab extends downward from the adjacent one of the lateral walls past a fold line connecting the adjacent one of the lateral walls to the lower wall. The retention tab is configured to engage two vertical, inward facing alignment edges of a similar container for alignment in a stack.

A second alignment tab can straddle a respective one of the upper fold lines. A first end of the second alignment tab can be connected to the upper wall by a first join line and a second end of the second alignment tab is connected by a second join line to a second one of the lateral walls that is opposite the adjacent one of the lateral walls. The second alignment tab can have two opposed lateral sides crossing the respective one of the upper fold lines. The second alignment tab also can have an intermediate fold line between the first and second ends of the second alignment tab that is closer to the first end than to the second end such that the second alignment tab projects upward from the upper wall and separates two vertical, inward facing alignment edges at an upper end of the second one of the lateral walls.

A second retention tab can extend downward from the second one of the lateral walls past a fold line connecting the second one of the lateral walls to the lower wall. The retention tab can be configured to engage two vertical, inward facing alignment edges of a similar container for alignment in a stack.

The upper wall can include four upper flaps, each foldably connected to a respective one of the lateral walls. The alignment tab can be formed of a portion of a first one of the four upper flaps that forms an inner layer of the upper wall and is at least partially covered by others of the four upper flaps that form an outer layer of the upper wall. The four upper flaps can have a gap therebetween opening into the interior space form a space exterior from the upper wall. The retention tab can be aligned with the gap.

The lower wall can include four lower flaps, each foldably connected to a respective one of the lateral walls. The retention tab can interrupt a fold line connecting the adjacent one of the lateral walls to a portion of a first one of the lower upper flaps that can form an inner layer of the lower wall and can be at least partially covered by others of the four lower flaps that form an outer layer of the lower wall.

The upper wall can include four upper flaps, each foldably connected to a respective one of the lateral walls. The alignment tab can be formed of a portion of a first one of the four upper flaps that can meet a second one of the four upper flaps to form an outer layer of the upper wall. The lower wall can include four lower flaps, each foldably connected to a respective one of the lateral walls. The retention tab can interrupt a fold line connecting the adjacent one of the lateral walls to a portion of a first one of the lower upper flaps that can meet a second one of the four lower flaps to form an outer layer of the lower wall.

A blank for a container as described above includes a plurality of panels for forming a polygonal section comprising lateral walls surrounding an interior space, a plurality of upper flaps foldably connected to respective ones of the lateral walls along respective upper fold lines and configured to form an upper wall forming at a top bound on the interior space, and a plurality of lower flaps foldably connected to respective ones of the lateral walls along respective lower fold lines and configured to form a lower wall at a bottom bound on the interior space. The blank includes an alignment tab that straddles a first one of the upper fold lines, wherein a first end of the alignment tab is connected to the first upper flap by a first join line and a second end of the alignment tab is connected to an adjacent one of the lateral walls by a second join line. The alignment tab has two opposed lateral sides crossing the respective one of the upper fold lines, wherein the alignment tab also has an intermediate fold line between the first and second ends of the alignment tab that is closer to the first end than to the second end, such that the alignment tab is configured to project upward from the upper wall and to separate two vertical, inward facing alignment edges at an upper end of the adjacent one of the lateral walls. The blank includes a retention tab extending downward from the adjacent one of the lateral walls across one of the lower old lines, wherein the retention tab is configured to engage two vertical, inward facing alignment edges of a similar container for alignment in a stack.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
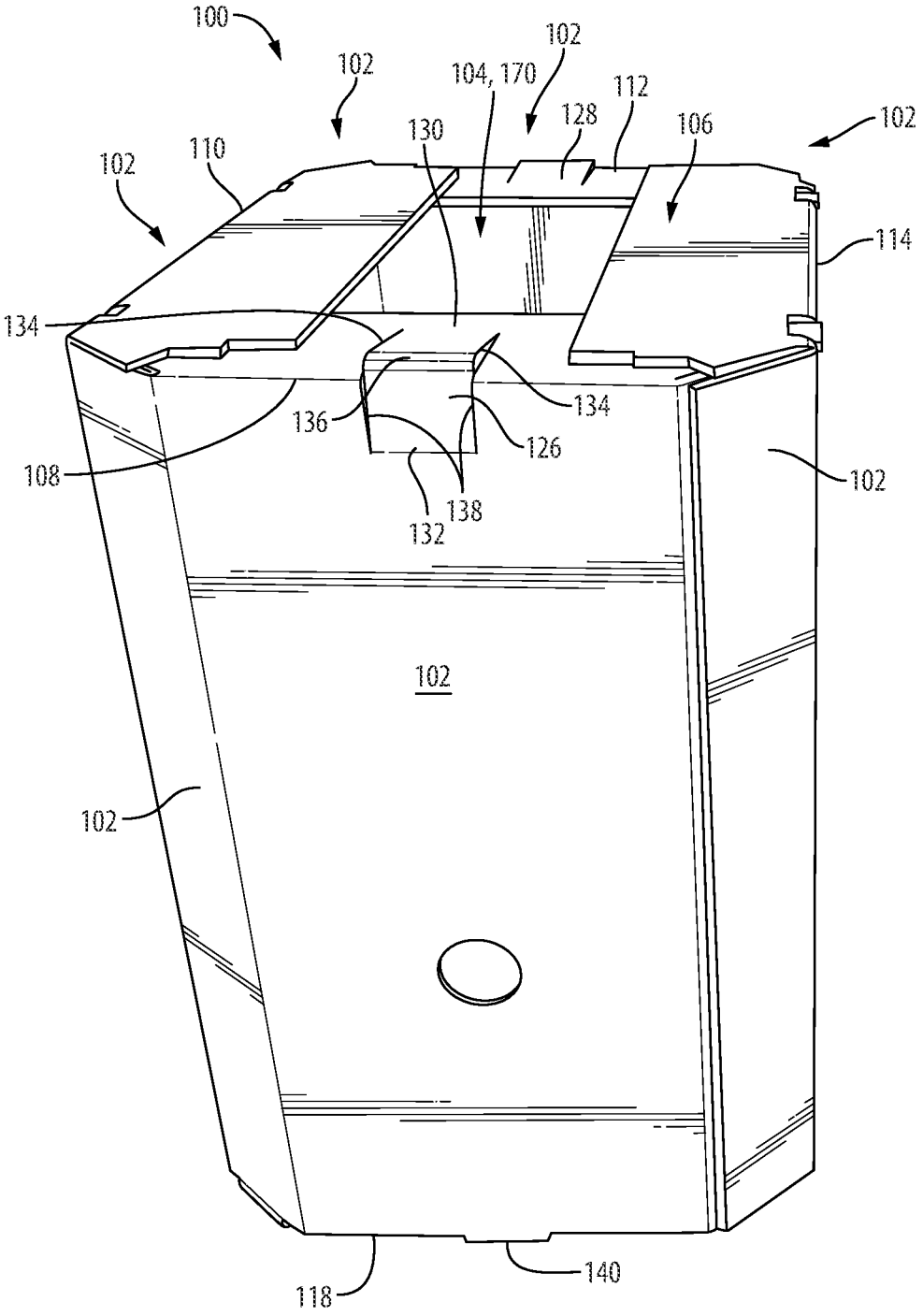
FIG. 1 is a perspective view of an embodiment of a container constructed in accordance with the present disclosure, showing the retention and alignment tabs.

Reference will now be made to the drawings wherein like reference numerals identify similar structural features or aspects of the subject disclosure. For purposes of explanation and illustration, and not limitation, a partial view of an embodiment of a container in accordance with the disclosure is shown in FIG. 1 and is designated generally by reference character 100. Other embodiments of systems in accordance with the disclosure, or aspects thereof, are provided in FIGS. 2-8, as will be described. The systems and methods described herein can be used to provide self-alignment of containers when stacking without forming any major holes in the bottom of the containers, and still allowing for cross-tied or pin wheel stacking configurations.

The container 100 includes a polygonal section comprising lateral walls 102 surrounding an interior space 104. An upper wall 106 forms a top bound on the interior space 104. The upper wall 106 is connected to the lateral walls 102 by upper fold lines 108, 110, 112, 114. A lower wall 116 forms a bottom bound on the interior space 104. The lower wall 116 is connected to the lateral walls 102 by lower fold lines 118, 120, 122, 124. There can be eight total lateral walls 102, as shown in FIGS. 1-4. It is also contemplated that there can be four total lateral walls, as will be described with reference to FIGS. 5-7. Those skilled in the art will readily appreciate that any suitable number of lateral walls can be used without departing from the scope of this disclosure.

Referring again to FIG. 1, an alignment tab 126 straddles the upper fold line 108, and another alignment tab 128 straddles the opposite upper fold line 112. A first end of the alignment tab 126 is connected to the upper wall 106 by a first join line 130 and a second end of the alignment tab 126 is connected to an adjacent one of the lateral walls 102 by a second join line 132. The alignment tab 126 has two opposed lateral sides 134 crossing the upper fold line 108. The second alignment tab 128 also has respective join lines 130, 132 and lateral sides 134 as described here for the first alignment tab 126, and these are not labeled in FIG. 1 for sake of clarity in the drawing, but see FIG. 4. The alignment tabs 126, 128 also each have an intermediate fold line 136 between the first and second ends of the alignment tab 126, 128 that is closer to the first end than to the second end, such that the alignment tab 126, 128 projects upward from the upper wall 106 and separates two vertical, inward facing alignment edges 138 (which are the opposite sides of the respective cut lines from lateral sides 134) at an upper end of the respective lateral walls 102.

With reference again to FIG. 1, a retention tab 140 extends downward from its lateral wall 102 past the fold line 118. A second retention tab 142, visible in FIG. 2, extends downward from its lateral wall 102 past the fold line 122 on the opposite side of the lower wall 116 from the first retention tab 140. Each retention tab 140, 142 is configured to engage the two vertical, inward facing alignment edges 138 of a similar container 100 for alignment of the containers 100 in a stack 10, as shown in FIG. 3.

Figure 2:
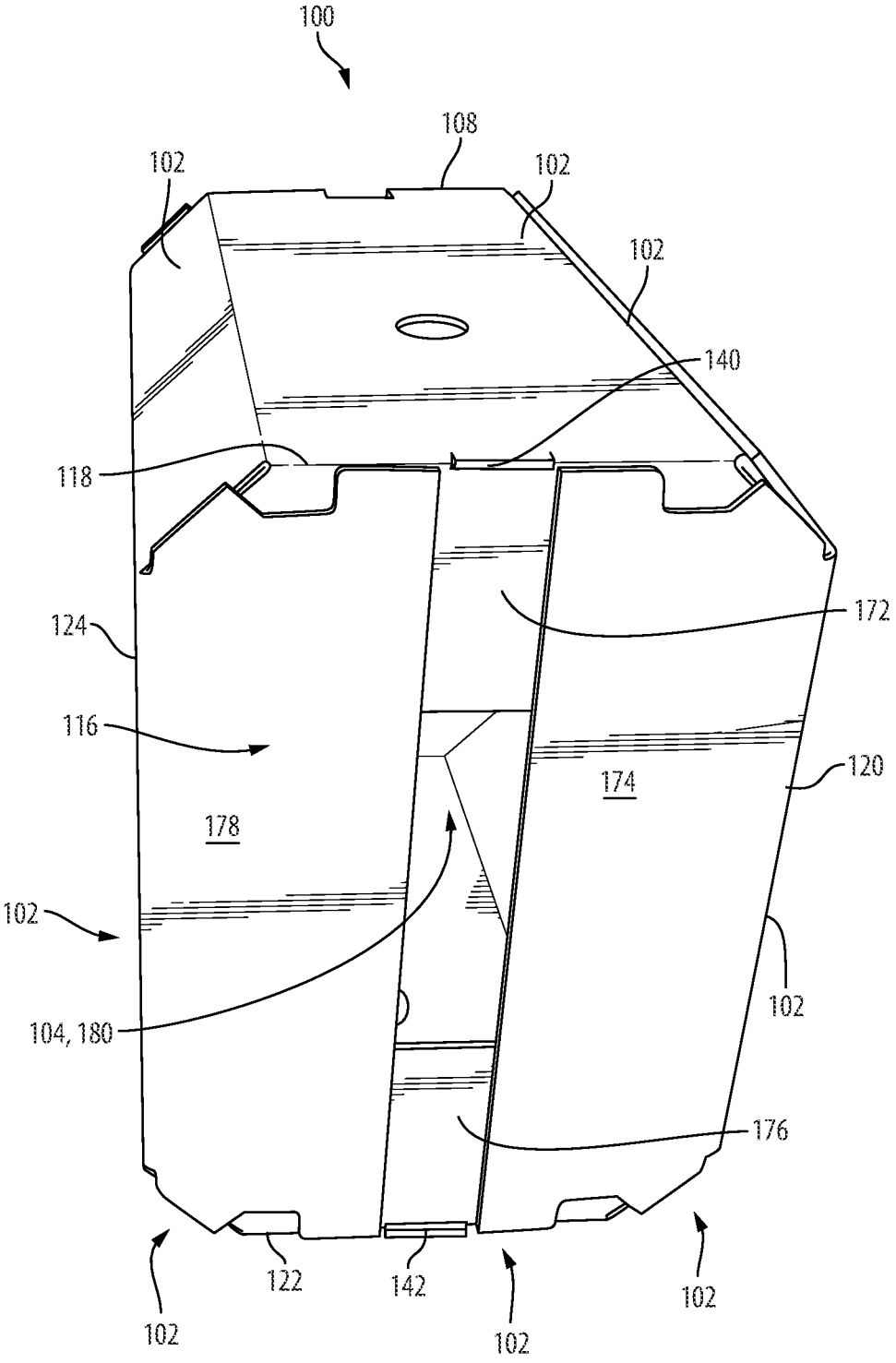
FIG. 2 is a perspective view of the container of FIG. 1, showing the lower flaps.
Figure 3:
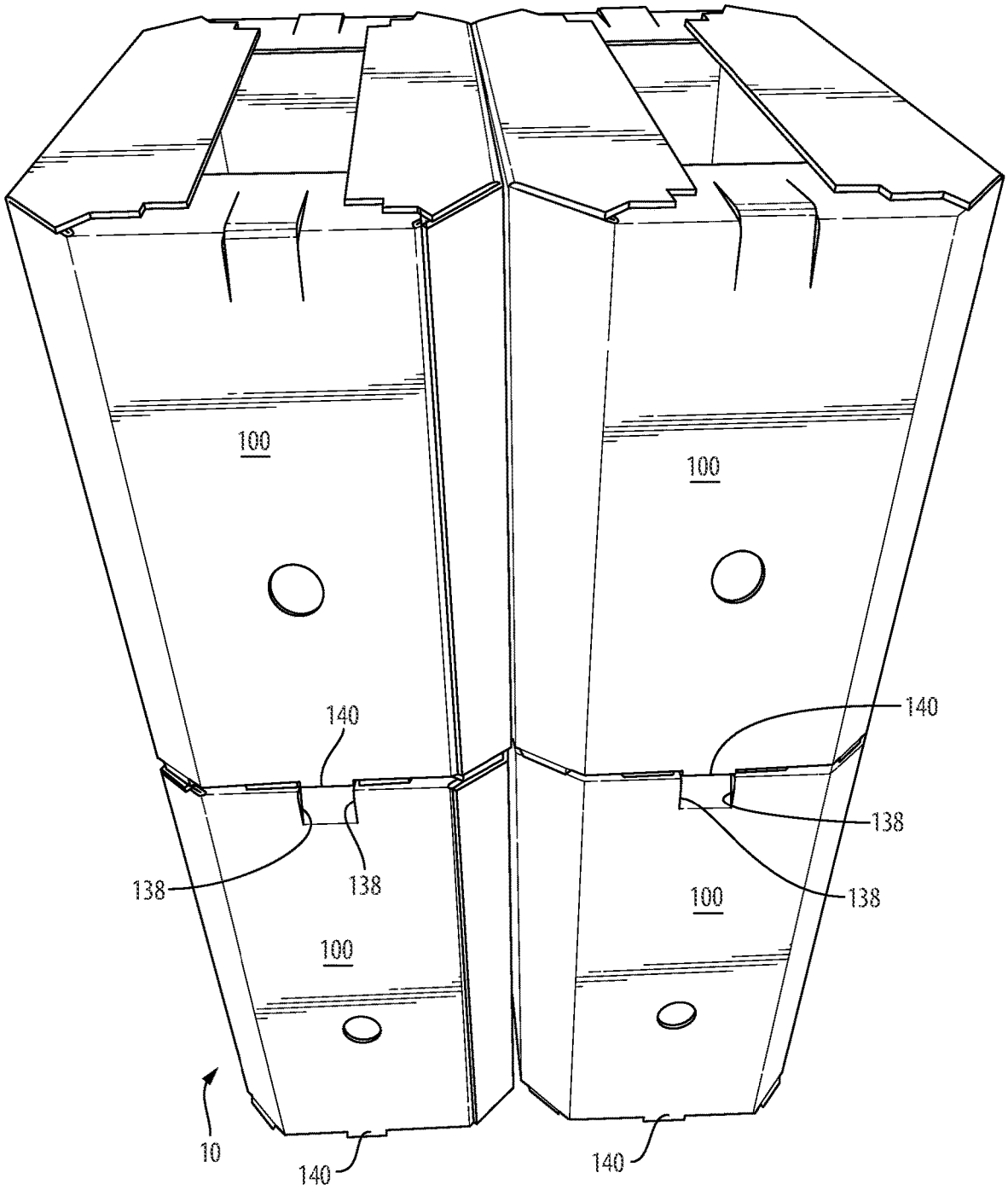
FIG. 3 is a perspective view of multiple containers of FIG. 1, showing the containers stacked with respective retention tabs interlocked with the inward facing alignment edges of the containers below.
Figure 4:
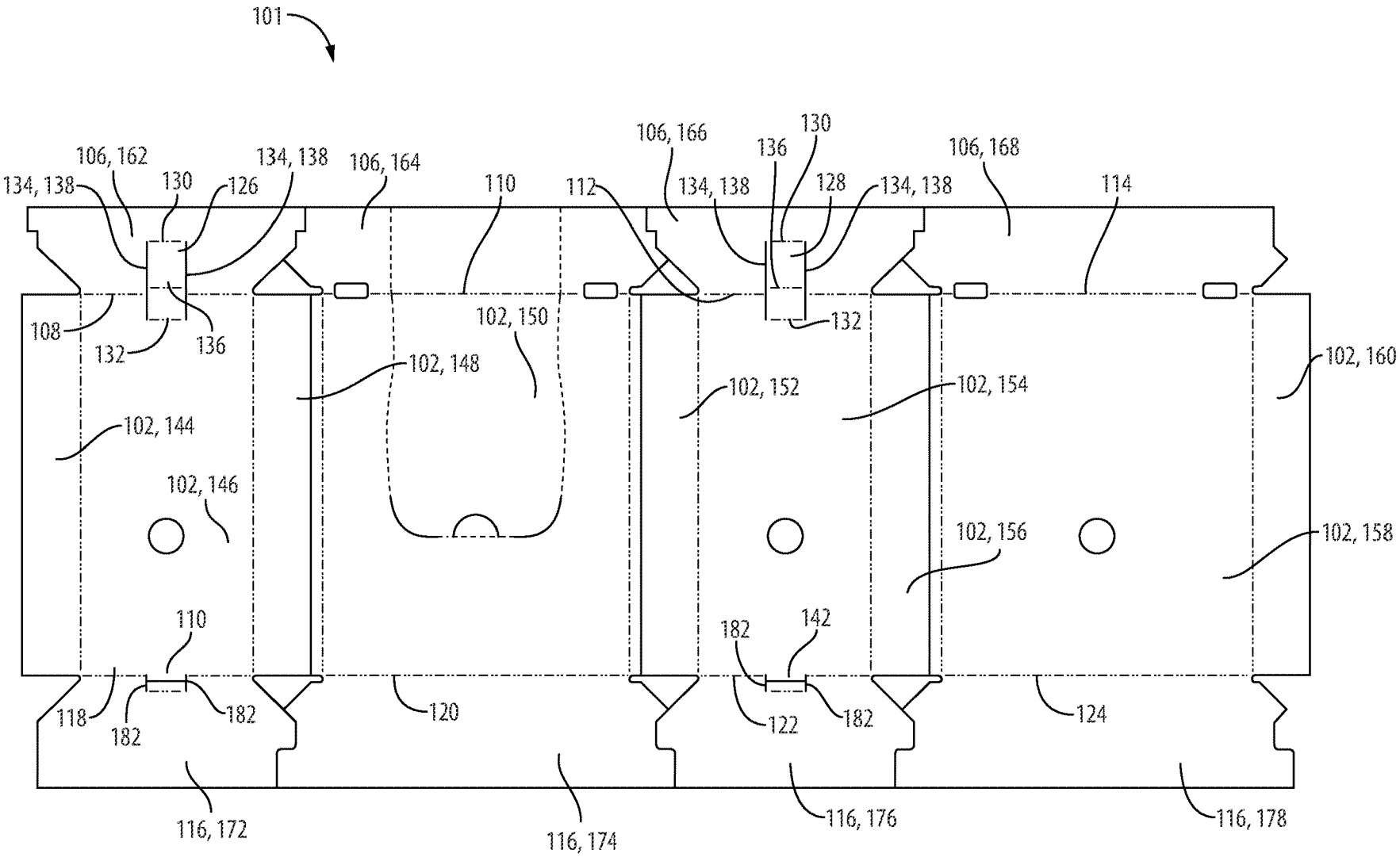
FIG. 4 is a plan view of a blank for the container of FIG. 1, showing the panels for the walls and flaps.

With reference now to FIG. 4, a blank 101 for forming the container of FIGS. 1-3 is shown. The lateral walls 102 are formed of eight panels 144, 146, 148, 150, 152, 154, 156, 158 connected to one another along respective fold lines, wherein panels 144, 148, 150, 156 form the beveled corner panels shown in FIGS. 1-3, and which are not connected to the upper and lower walls 106, 116 by fold lines. The panel 160 overlaps with the panel 144 to which panel 160 is adhered in forming the container 100 around the interior space 104 shown in FIG. 1 using the fold lines of the blank 101. The upper wall 106 includes four upper flaps 162, 164, 166, 168, each foldably connected to a respective one of the lateral walls 146, 150, 154, 158 along a respective fold line 108, 110, 112, 114. The alignment tabs 126, 128 are formed of respective portions of a the four upper flaps 162, 166 that form an inner layer of the upper wall 106 and that are partially covered by the upper flaps 164, 168 that form an outer layer of the upper wall when the blank 101 is formed into a container 100 as shown in FIG. 1 (the flaps are not numbered in FIG. 1 for sake of clarity in the drawing). The four upper flaps 162, 164, 166, 168 (numbered in FIG. 4) have a gap 170 therebetween in the erected container 101, as labeled in FIG. 1. The gap 170 opens into the interior space 104 form the space exterior from the upper wall 106. The retention tabs 126, 128 are both aligned with the gap 170 and with each other across the gap 170.

With reference again to FIG. 4, the lower wall 116 includes four lower flaps 172, 174, 176, 178, each foldably connected to a respective one of the lateral walls 146, 150, 154, 158 by the respective fold lines 118, 120, 122, 124. The retention tabs 140, 142 interrupt their respective fold lines 118, 122, which connect to the lower upper flaps 172, 176. The lower flaps 172, 176 form an inner layer of the lower wall 116 when the blank 101 is erected into a container 101 as shown in FIG. 2, wherein the inner layer is partially covered by the lower flaps 174, 178 that form an outer layer of the lower wall 116. There is a gap 180 between the flaps 172, 174, 176, 178 that communicates from the interior space 104 to the space exterior of the lower wall 116. The retention tabs 140, 142 are aligned with the gap 180, and are situated just between the flaps 174, 178, as shown in FIG. 2. As shown in FIG. 4, the retention tabs 140, 142 are formed between respective cuts 182 in the blank 101, and a fold or score line 184 can be formed in the respective flap 172, 176 of the respective retention tabs 140, 142. The fold or score line 184 is at one end of the cuts 182, which facilitates accommodation of the respective alignment tab in the lower wall 106 in the stack 10 as shown in FIG. 3. The cuts for the edges 134, 138 of the alignment tab 126 are aligned with the cuts 182 of the retention tab 140. Similarly, the cuts for the edges 134, 138 of the alignment tab 128 are aligned with the cuts 182 of the retention tab 142.

Figure 5:
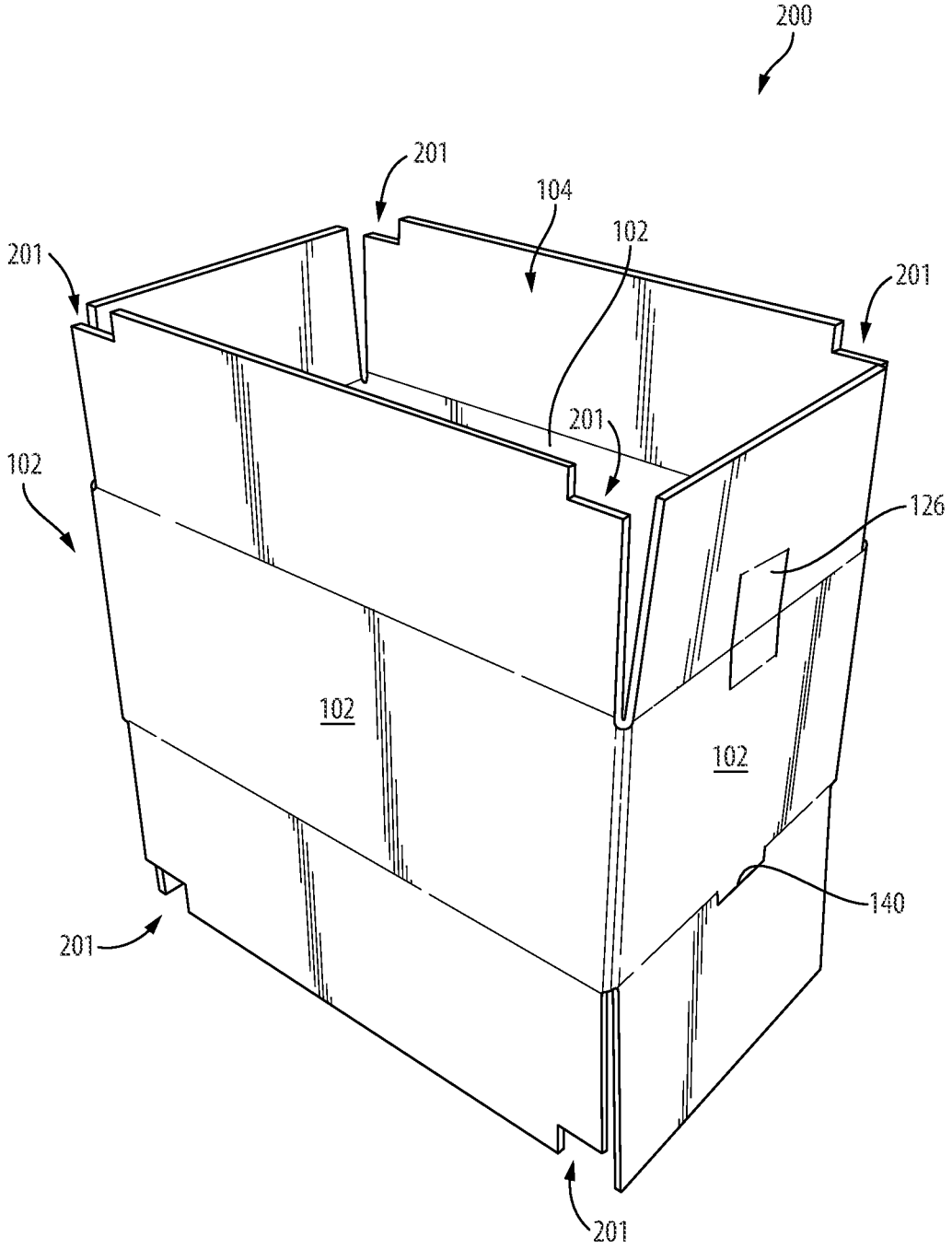
FIG. 5 is a perspective view of a of another embodiment of a container constructed in accordance with the present disclosure, showing four lateral walls.
Figure 6:
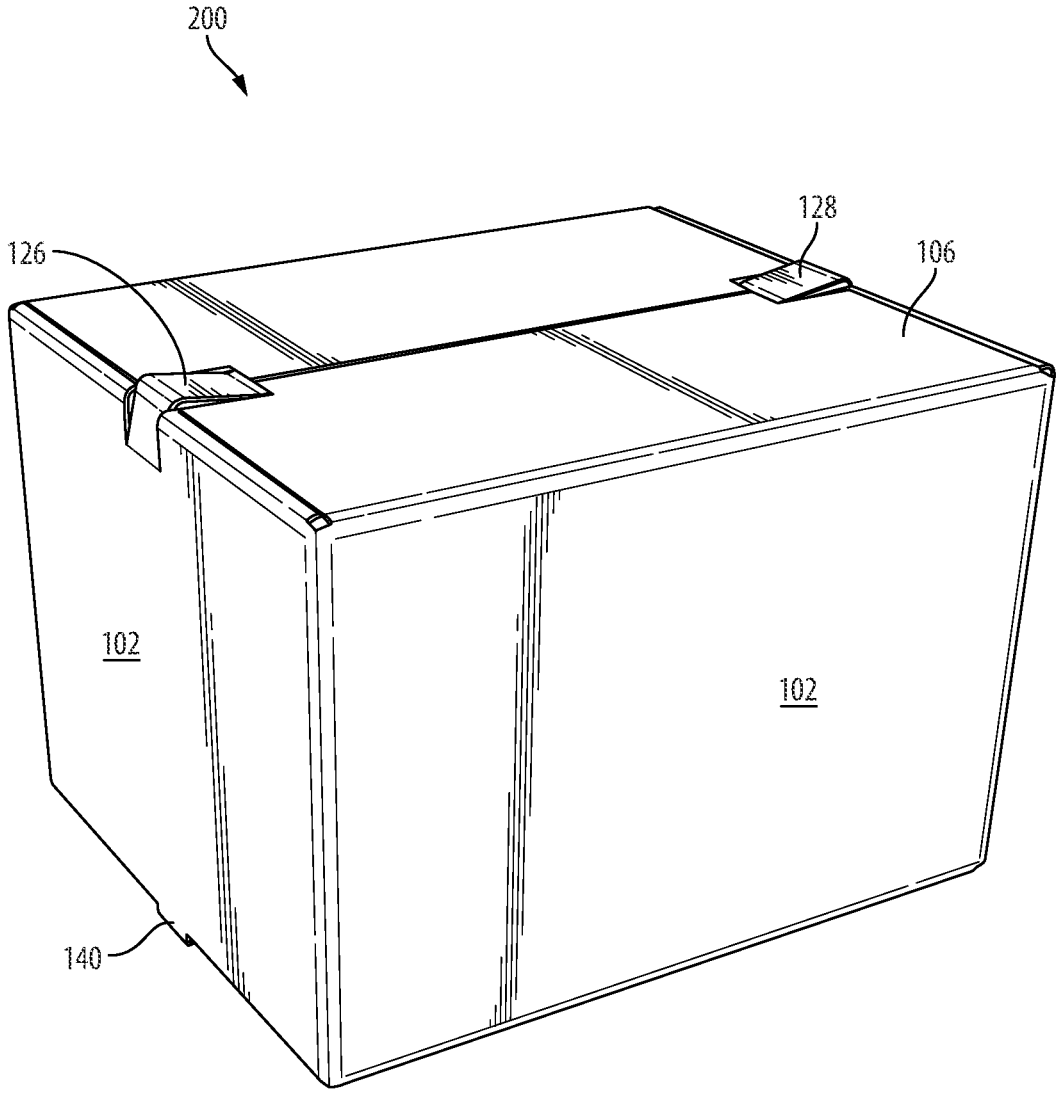
FIG. 6 is a perspective view of the container of FIG. 5, showing the upper flaps closed with the alignment taps standing upward from the top of the container.
Figure 7:
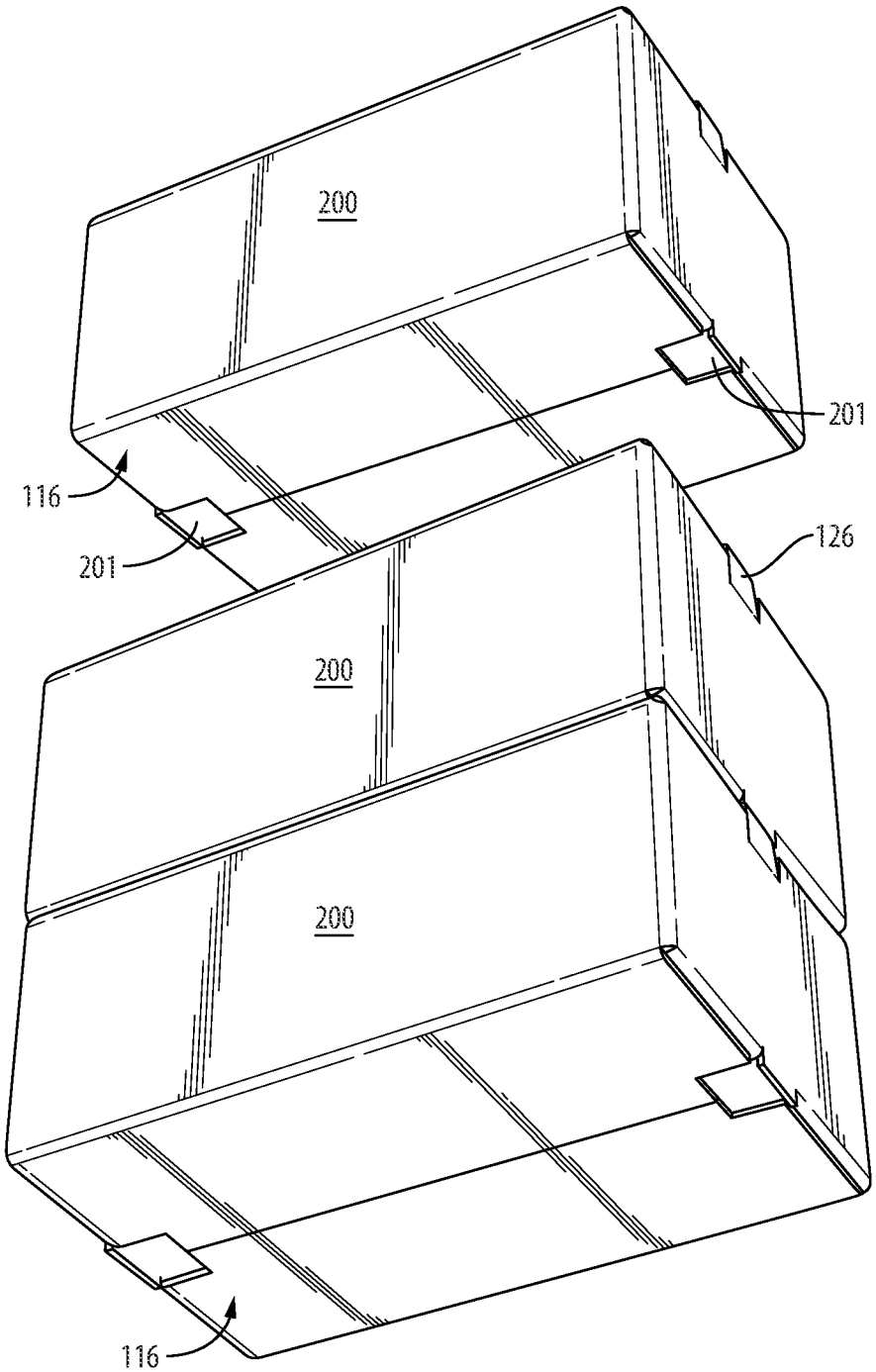
FIG. 7 is a perspective view of three of the containers of FIG. 5, showing stacking of the containers.

With reference now to FIG. 5, another embodiment of a container 200 is shown, with similar alignment tabs 126, 128 and retention tabs 140, 142 to those described above. The container 200 is similar to the container 100 described above, but omits the panels 144, 148, 150, 156 labeled in FIG. 4, so the container 200 is has a four-sided foot print instead of an eight-sided footprint as in container 100 of FIG. 1. The flaps of the upper wall 106 meet so there is no gap 170 therebetween as in FIG. 1, and similarly as shown in FIG. 7, the flaps of the lower wall 116 meet so there is no gap 180 as in FIG. 2. There is a notch 201 cut out of the outer most flaps which is positioned proximate each retention tab 140, 142 of the lower wall, and cut out of the outer most flaps and positioned proximate each alignment tab 126, 128 when the container 200 is erected to accommodate the engagement of the alignment tabs 126, 128 of a lower container 200 with the retention tabs 140, 142 when stacking.

Figure 8:
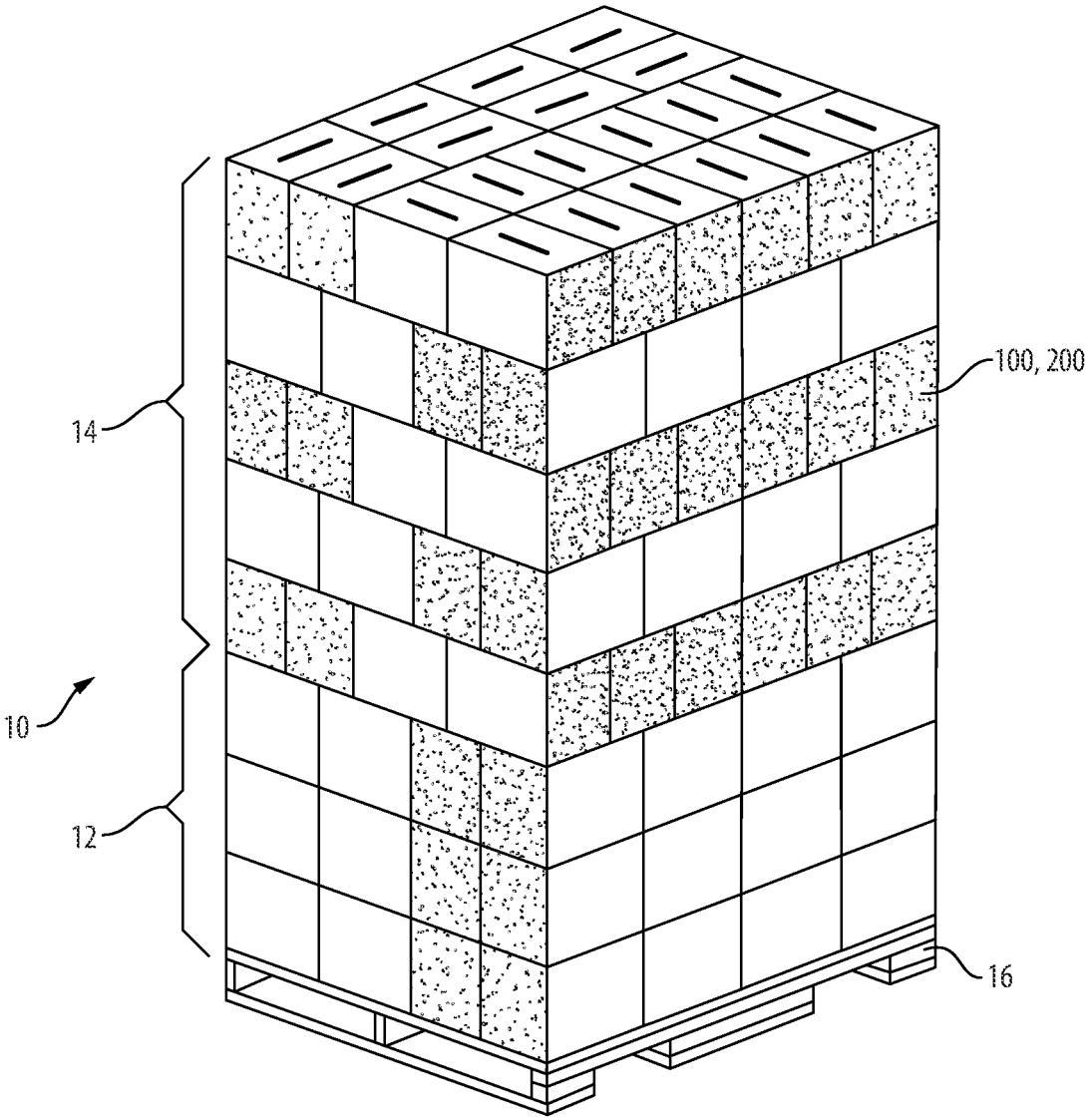
FIG. 8 is a schematic perspective view of the containers of FIG. 1, showing the stack with two different stacking patterns.

With reference now to FIG. 8, containers 100, 200 can be stacked into a stack 10 on a pallet 16. The alignment and retention tabs 126, 128, 140, 142 described above with reference to FIGS. 1-7 can accommodate a straight stack where each container 100, 200 is directly aligned on top of the container 100, 200 below it as in section 12 of the stack 10. The alignment and retention tabs 126, 128, 140, 142 can also accommodate other stacking patterns such as pinwheeled or cross tied patters where the containers 100, 200 are each stacked on portions of two containers 100, 200 below without being aligned with the foot print of the containers 100, 200 below, as in section 14 of the stack 10.

The methods and systems of the present disclosure, as described above and shown in the drawings, provide for self-alignment of containers when stacking without forming any major holes in the bottom of the containers, and still allowing for cross-tied or pin wheel stacking configurations. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A container comprising:

a polygonal section comprising lateral walls surrounding an interior space;

an upper wall forming a top bound on the interior space, the upper wall being connected to at least two of the lateral walls by upper fold lines;

a lower wall forming a bottom bound on the interior space, the lower wall being connected to at least two of the lateral walls by lower fold lines;

an alignment tab that straddles a respective one of the upper fold lines, wherein a first end of the alignment tab is connected to the upper wall by a first join line and a second end of the alignment tab is connected to an adjacent one of the lateral walls by a second join line, wherein the alignment tab has two opposed lateral sides crossing the respective one of the upper fold lines, wherein the alignment tab also has an intermediate fold line between the first and second ends of the alignment tab that is closer to the first end than to the second end, such that the alignment tab projects upward from the upper wall and separates two vertical, inward facing alignment edges at an upper end of the adjacent one of the lateral walls, and a retention tab extending downward from the adjacent one of the lateral walls past a fold line connecting the adjacent one of the lateral walls to the lower wall, wherein the retention tab is configured to engage two vertical, inward facing alignment edges of a similar container for alignment in a stack.

2. The container as recited in claim 1, wherein the alignment tab is a first alignment tab, and further comprising:

a second alignment tab that straddles a respective one of the upper fold lines, wherein a first end of the second alignment tab is connected to the upper wall by a first join line and a second end of the second alignment tab is connected by a second join line to a second one of the lateral walls that is opposite the adjacent one of the lateral walls, wherein the second alignment tab has two opposed lateral sides crossing the respective one of the upper fold lines, wherein the second alignment tab also has an intermediate fold line between the first and second ends of the second alignment tab that is closer to the first end than to the second end, such that the second alignment tab projects upward from the upper wall and separates two vertical, inward facing alignment edges at an upper end of the second one of the lateral walls.

3. The container as recited in claim 2, wherein the retention tab is a first retention tab, and further comprising:

a second retention tab extending downward from the second one of the lateral walls past a fold line connecting the second one of the lateral walls to the lower wall, wherein the retention tab is configured to engage two vertical, inward facing alignment edges of a similar container for alignment in a stack.

4. The container as recited in claim 1, wherein the upper wall includes four upper flaps, each foldably connected to a respective one of the lateral walls, wherein the alignment tab is formed of a portion of a first one of the four upper flaps that forms an inner layer of the upper wall and is at least partially covered by others of the four upper flaps that form an outer layer of the upper wall.

5. The container as recited in claim 4, wherein the four upper flaps have a gap therebetween opening into the interior space form a space exterior from the upper wall, and wherein the retention tab is aligned with the gap.

6. The container as recited in claim 1, wherein the lower wall includes four lower flaps, each foldably connected to a respective one of the lateral walls, wherein the retention tab interrupts a fold line connecting the adjacent one of the lateral walls to a portion of a first one of the lower upper flaps that forms an inner layer of the lower wall and is at least partially covered by others of the four lower flaps that form an outer layer of the lower wall.

7. The container as recited in claim 1, wherein the upper wall includes four upper flaps, each foldably connected to a respective one of the lateral walls, wherein the alignment tab is formed of a portion of a first one of the four upper flaps that meets a second one of the four upper flaps to form an outer layer of the upper wall.

8. The container as recited in claim 1, wherein the lower wall includes four lower flaps, each foldably connected to a respective one of the lateral walls, wherein the retention tab interrupts a fold line connecting the adjacent one of the lateral walls to a portion of a first one of the lower upper flaps that meets a second one of the four lower flaps to form an outer layer of the lower wall.

9. The container as recited in claim 1, wherein there are eight total lateral walls.

10. The container as recited in claim 1, wherein there are four total lateral walls.

11. A blank for a container comprising:

a plurality of panels for forming a polygonal section comprising lateral walls surrounding an interior space;

a plurality of upper flaps foldably connected to respective ones of the lateral walls along respective upper fold lines and configured to form an upper wall forming at a top bound on the interior space;

a plurality of lower flaps foldably connected to respective ones of the lateral walls along respective lower fold lines and configured to form a lower wall at a bottom bound on the interior space;

an alignment tab that straddles a first one of the upper fold lines, wherein a first end of the alignment tab is connected to the first upper flap by a first join line and a second end of the alignment tab is connected to an adjacent one of the lateral walls by a second join line, wherein the alignment tab has two opposed lateral sides crossing the respective one of the upper fold lines, wherein the alignment tab also has an intermediate fold line between the first and second ends of the alignment tab that is closer to the first end than to the second end, such that the alignment tab is configured to project upward from the upper wall and to separate two vertical, inward facing alignment edges at an upper end of the adjacent one of the lateral walls, and a retention tab extending downward from the adjacent one of the lateral walls across one of the lower old lines, wherein the retention tab is configured to engage two vertical, inward facing alignment edges of a similar container for alignment in a stack.

12. The blank as recited in claim 11, wherein the alignment tab is a first alignment tab, and further comprising:

a second alignment tab that straddles a respective one of the upper fold lines, wherein a first end of the alignment tab is connected to a second one of the upper flaps by a first join line and a second end of the alignment tab is connected by a second join line to a second one of the lateral walls that is opposite the adjacent one of the lateral walls, wherein the second alignment tab has two opposed lateral sides crossing the respective one of the upper fold lines, wherein the second alignment tab also has an intermediate fold line between the first and second ends of the second alignment tab that is closer to the first end than to the second end, such that the second alignment tab is configured to project upward from the upper wall and separates two vertical, inward facing alignment edges at an upper end of the second one of the lateral walls.

13. The blank as recited in claim 12, wherein the retention tab is a first retention tab, and further comprising:

a second retention tab extending downward from the second one of the lateral walls past a respective one of the lower fold lines connecting the second one of the lateral walls to the lower wall, wherein the retention tab is configured to engage two vertical, inward facing alignment edges of a similar container for alignment in a stack.

14. The blank as recited in claim 11, wherein there are four upper flaps, each foldably connected to a respective one of the lateral walls, wherein the alignment tab is formed of a portion of a first one of the four upper flaps that is configured to form an inner layer of the upper wall and to be at least partially covered by others of the four upper flaps that form an outer layer of the upper wall.

15. The blank as recited in claim 14, wherein the four upper flaps are configured to have a gap therebetween opening into the interior space form a space exterior from the upper wall, and wherein the retention tab is configured to be aligned with the gap.

16. The blank as recited in claim 11, wherein there are four lower flaps, each foldably connected to a respective one of the lateral walls, wherein the retention tab interrupts a fold line connecting the adjacent one of the lateral walls to a portion of a first one of the lower upper flaps that is configured to form an inner layer of the lower wall and to be at least partially covered by others of the four lower flaps that form an outer layer of the lower wall.

17. The blank as recited in claim 11, wherein there are four upper flaps, each foldably connected to a respective one of the lateral walls, wherein the alignment tab is formed of a portion of a first one of the four upper flaps that is configured to meet a second one of the four upper flaps to form an outer layer of the upper wall.

18. The blank as recited in claim 11, wherein there are four lower flaps, each foldably connected to a respective one of the lateral walls, wherein the retention tab interrupts a fold line connecting the adjacent one of the lateral walls to a portion of a first one of the lower upper flaps that is configured to meet a second one of the four lower flaps to form an outer layer of the lower wall.

19. The blank as recited in claim 11, wherein there are eight total panels for forming the lateral walls.

20. The blank as recited in claim 11, wherein there are four total panels for forming the lateral walls.

* * * * *